US006305112B1

(12) United States Patent
Hansen

(10) Patent No.: US 6,305,112 B1
(45) Date of Patent: Oct. 23, 2001

(54) FRAME FOR FRAMING PICTURES

(76) Inventor: C. C. Steffen Hansen, Frederiksborgvej 108, DK-4000 Roskilde (DK)

( * ) Notice: Subject to any disclaimer, the term of this patent is extended or adjusted under 35 U.S.C. 154(b) by 0 days.

(21) Appl. No.: 09/273,734

(22) Filed: Mar. 22, 1999

Related U.S. Application Data

(60) Provisional application No. 60/094,027, filed on Jul. 27, 1998.

(30) Foreign Application Priority Data

Jun. 3, 1998 (DK) ..... 1998 00211 U
Oct. 21, 1998 (DK) ..... 1998 01358

(51) Int. Cl.[7] ..... A47G 1/06
(52) U.S. Cl. ..... 40/743; 40/768; 40/792; 40/798
(58) Field of Search ..... 40/732, 743, 768, 40/782, 783, 790, 792, 798, 799, 800

(56) References Cited

U.S. PATENT DOCUMENTS

| | | | | |
|---|---|---|---|---|
| 2,612,244 | * | 9/1952 | Kiefer | 52/775 |
| 3,687,770 | * | 8/1972 | Chase | 40/773 X |
| 3,899,844 | | 8/1975 | Munn . | |
| 3,956,839 | * | 5/1976 | Yoshida | 40/782 X |
| 3,965,601 | | 6/1976 | Nielsen . | |
| 4,233,765 | | 11/1980 | O'Mullan et al. . | |
| 4,850,125 | | 7/1989 | Green . | |
| 4,879,824 | * | 11/1989 | Galloway | 40/763 |
| 5,303,488 | * | 4/1994 | Todd et al. | 40/798 X |
| 5,896,690 | * | 4/1999 | Suesholtz | 40/800 X |

FOREIGN PATENT DOCUMENTS

| | | |
|---|---|---|
| 24 47 041 | 5/1975 | (DE) . |
| 25 02 636 | 6/1976 | (DE) . |
| 0 254 684 | 1/1988 | (EP) . |
| 0 367 129 | 5/1990 | (EP) . |
| 1 463 331 | 2/1977 | (GB) . |
| 2 262 790 | 6/1993 | (GB) . |
| 2 276 083 | 9/1994 | (GB) . |
| WO 91/01102 | 2/1991 | (WO) . |
| WO 94/25296 | 11/1994 | (WO) . |

* cited by examiner

*Primary Examiner*—Brian K. Green
(74) *Attorney, Agent, or Firm*—Sughrue, Mion, Zinn, Macpeak & Seas, PLLC

(57) ABSTRACT

A frame for framing pictures has frame sections each having an external side wall connecting a channel for corner brackets on the back of the frame section with a visible front surface, which extends from the side wall towards a picture element in the frame. A screen wall extends from a holding lip down past a supporting lip to a bottom surface. A clear gap between the front surface of the frame section and the screen wall is of a smaller width than the distance from the holding lip to the bottom surface.

21 Claims, 5 Drawing Sheets

FRAME FOR FRAMING PICTURES

CROSS-REFERENCE TO RELATED APPLICATIONS.

The present application claims the benefit of priority from Danish Utility Model Application No. BA 1998 00211 filed on Jun. 3, 1998, from Danish patent application No. PA 1998 01358 filed on Oct. 21, 1998, and from U.S.A. provisional application No. 60/094,027 filed on Jul. 27, 1998.

BACKGROUND OF THE INVENTION

The present invention relates to a frame for framing pictures and being composed of a plurality of frame sections.

It is well-known to manufacture picture frames from extruded aluminum sections which are mitred in suitable lengths and arranged around the picture e element, whereupon the members are assembled into a whole frame by means of corner brackets, and clip bodies, typically in the form of leaf springs, are disposed between the supporting lip and the picture element back to fix the latter to the frame. Such picture frames are distinguished by rapid assembly and a relatively nice appearance while being very robust.

Picture frames of this type a re suitable for picture elements composed of several different layers, such as an external layer of glass and a picture surface located behind it and supported by a rigid panel, but are normally not used in case of pictures on frame-mounted canvas. Simultaneous with the framing, the layered picture elements must be fixed in the frame.

German patent publication No. DT 24 47 041 B2 describes a frame of the above type in which the screen wall stands upright from the visible front surface of the frame section and in which the supporting lip is a loose element that can be arranged at two different distances from the holding lip to accommodate the actual thickness of the picture element. The screen wall is manufactured quite conventionally with a depth corresponding to the thickness of the picture element so that the picture flushes with the lowest part of the stepped front surface of the frame section when the picture element comprises glass, mat, picture and backing. Paintings are also known which are painted on canvas on a blind frame, the surrounding frame being at a distance from the edge of the painting. EP 0 367 129 A2 describes a picture kept at a distance from a frame by means of four stiffeners mounted between the corners of the picture and the frame, respectively.

BRIEF SUMMARY OF THE INVENTION

It is a purpose of the present invention to provide a picture frame having an aesthetically attractive appearance while retaining the known advantages of using prefabricated frame sections.

It is another purpose of the present invention to present printed pictures, such as posters, in a manner so that the presence of the frame does not disturb the viewing of the picture.

It is a another purpose to allow easy mounting of a picture element comprising a pane of glass and a picture mounted on a backing.

According to the present invention each frame section has a bottom surface, a frame section back with a channel for corner brackets, an upstanding screen wall on said bottom surface, an external side wall connecting the bottom surface with a visible front surface, and a clear gap between the front surface of the frame section and the screen wall, said visible front surface extending from the external side wall towards a picture element in the frame, said screen wall having a projecting holding lip and a subjacent supporting lip for the picture element, said screen wall extending a distance down past the supporting lip to the bottom surface, and said clear gap between the front surface of the frame section and the screen wall being of a smaller width than said distance from the holding lip to the bottom surface.

By placing the screen wall on a bottom surface which extends to the external side wall independently of the front surface, the front surface is visually disconnected from the screen wall and thus from the picture element and the bottom surface is located further down than the back of the picture element, e.g. further down than the supporting lip. At normal lighting, the bottom surface will remain substantially darker than the front surface of the frame section, which appears clearly illuminated, and the contrast between these light conditions gives the impression that the picture element is hovering or floating in the frame.

Preferably, the depth of the screen wall between the supporting lip and the bottom surface is at least half the depth from the holding lip to the supporting lip. This provides a suitably large distance between the picture element front and the bottom surface so that the latter can be untreated and have the same surface character as the front surface of the frame section without giving the impression of being illuminated, and the manufacture of the frame section may thus be finished by performance of the extrusion.

Preferably, the holding lip is at a shorter distance from the bottom surface than the visible front surface, as this makes the visible front surface more prominent and enhance the visual effects of the clear gap.

The visual separation of the front surface of the frame from the picture element can suitably be strengthened by the front surface of the frame section ending at the clear gap in a wall part extending substantially in parallel with the screen wall and towards the bottom surface. Alternatively, the wall part can be omitted.

The wall part can extend fully to the bottom surface with the result that the external side wall, the front surface, the wall part and the channel on the back form a closed cross-section. Alternatively, the wall part can end in a free edge located at a distance from the bottom surface, providing the effect that nearest the bottom surface there is a cavity at the side of the clear gap opposite to the screen wall. The cavity makes the bottom surface appear darker, because reflected light from the wall part is avoided, and reflected light from the screen wall enters into the cavity. Consequently, the bottom surface may be closer to the holding lip without appearing as an illuminated surface.

The shadow-creating effect of the cavity can be heightened by the back of the external side wall and of said front surface and possibly the bottom surface being matt and/or provided with a light-absorbent coating, such as black paint.

Preferably, the bottom surface is plane and through-going directly from the screen wall to the external side wall, but it is possible to give the bottom surface a stepped shape upwards or downwards, which may be an advantage in case the part of the bottom surface located in the clear gap is desired at a predetermined distance from the holding lip, and the bottom of the channel for the corner brackets is at a distance from the visible front surface of the frame section different from said predetermined distance.

The width of the clear gap between the front surface of the frame section and the screen wall may suitably be in the interval from 6 to 12 mm, preferably around 8 mm, which provides an aesthetically attractive appearance of the framed picture. If the width of the clear gap becomes substantially larger than 12 mm, the frame section as a whole must be larger for the clear gap to obtain a depth that makes the bottom surface appear visually subdued or absent.

The clear gap on the outside of the screen wall provides a functional separation of the actual mounting of the picture from the frame section, which is located radially outside the clear gap and is perceived as the frame proper around the picture. In an embodiment this has been exploited so that the visible front surface and possibly also the outer surface of the frame section is/are disposed on a separate element mounted on the remaining part of the frame section. This separate element can be designed in an especially expressive shape in another material than the remaining, extruded part of the frame section, which provides great freedom to give the same basic frame very varied expressions in terms of design. The separate element can further be exchangeable, such as a plastics strip that can be pressed into a channel-like opening in the front of the frame.

The frame is very suitable for framing of posters, pictures on paper, cardboard or a panel, possibly being glued to a supporting backing, where there is a layer of glass and possibly a mat over the picture. Such layered picture element can be retained securely in the frame with the rim area of the picture element front being positioned behind and pressed against the holding lip. The desired aesthetical effect of framing a picture element with a frame according to the invention can be further heightened by the frame framing a picture element comprising a backing to which is glued a sheet of paper with a printed picture possibly being coated with a protective, low-reflecting layer and by the picture element being glass-free. Also in this case the holding lip extends over a rim area of the picture element front. By avoiding the use of the glass layer, the printed picture obtains a more direct appearance not bothered by reflexes and having a certain similarity with a painting. This is supported by the undisturbed impression obtained by apparently arranging the frame at a distance from the picture.

Alternatively, the frame can be for framing of a painting on canvas mounted on a stretcher, wherein at least one mounting element is fixed to each side surface of the stretcher, and the mounting elements are mounted in the frame held by the holding and the supporting lips. By using mounting elements shaped for engagement with the lips on the frame sections mounting of the stretcher with canvas in a frame is greatly facilitated, and standard framing elements can be used.

An embodiment which is suitable for framing both printed pictures on a backing and paintings on canvas, is characterized in that the holding lip extends a first distance away from the screen wall, that the supporting lip extends a second distance away from the screen wall, which second distance is larger than said first distance and that the supporting lip at the area of about said first distance has a weakening line extending longitudinally in parallel with the screen wall. When the frame is used with pictures on a backing the supporting lip can be left as it is, but in case the frame is used with paintings on canvas, the part of the supporting lip positioned opposite to the screen wall can be bent away or removed, which allows the stretcher to extend down past the supporting lip.

In another embodiment the frame frames a picture element including a pane of glass and a backing carrying a picture, and a spacing member extends along the edges of the backing and separates the pane of glass from the picture. A very easy mounting and an attractively simple appearance is obtained by mounting the pane of glass in between the holding lip and the supporting lip and by using part of the frame sections as the spacing member. The previous need for cutting four loose strip members and positioning these correctly in between the backing and the pane of glass is thus abolished.

BRIEF DESCRIPTION OF THE SEVERAL VIEWS OF THE DRAWING

Examples of the invention will now be explained below with reference to the very schematical drawings, in which.

DETAILED DESCRIPTION OF THE INVENTION

Figure 1:
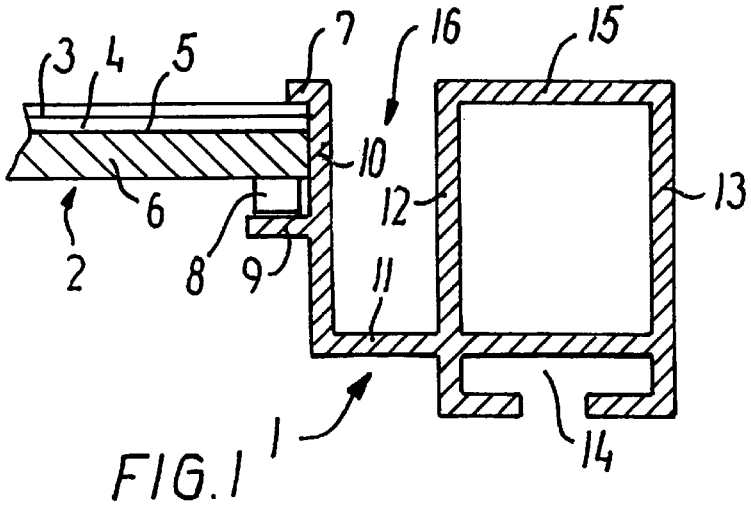
FIG. 1 is a cross-sectional view through a first embodiment of a frame according to the invention.

FIG. 1 shows the cross-section of a frame section 1 constituting one out of four sides of substantially identical cross-sectional configuration of a frame for framing a picture element 2, which comprises an outermost layer of glass 3, a mat 4, a sheet of paper 5 with a painted or printed picture and a backing in the form of a panel 6 supporting the sheet of paper. As mentioned above, the picture element may be without a mat, and also the glass may be omitted. The individual layers of the picture element are pressed towards the inner surface of a holding lip 7 by means of a number of clip bodies 8, which may be leaf springs, wedges, rubber blocks with suitably resilient properties or other types of elastic elements which, when arranged on or in a supporting lip 9, may press a picture element of a certain thickness, which may vary from one picture element to another, outwards at a suitably large force.

The holding lip 7 and the supporting lip 9 extend from a screen wall 10 which covers the side-facing joining surfaces in the picture element so that the viewer only sees the front of the picture itself and the frame around the picture. The screen wall continues downwards past the supporting lip to a bottom surface 11 extending outwards past a wall part 12 and out to an external side wall 13 which is seen as the external side wall of the frame.

A channel 14 for corner brackets is located at the back of the bottom surface. The channel is formed by a pair of L-shaped member and a portion of the bottom surface 11. By means of four corner brackets of a conventional type, the four mitred frame sections may be assembled into a whole frame around the picture element.

A front surface 15 on the frame section extends from the side wall 13 to the wall part 12 and to the viewer looks like the actual frame. Between the front surface and the screen wall 10 there is a clear gap 16 which is of substantially larger depth than width, which makes the bottom surface 11 lie in a relatively darker area visually making the picture float in the frame. For most frame types, the desired visual effect is obtained when the distance from the holding lip to the bottom surface is at least 14 mm. As mentioned above, however, a slightly shorter distance can be used in combination with a cavity and/or a coating, if a particularly slender frame is desired. Preferably, the distance from the front surface of the frame to the bottom surface is at least 20 mm. The clear gap may advantageously have a depth being at least about 2.5 times larger than the width of the clear gap.

In the following description of other embodiments the same reference numerals will be used as above for elements of the same kind or function.

Figure 2:
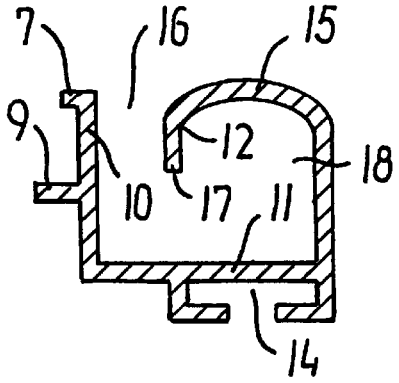
FIGS. 2–5 are corresponding cross-sectional views through four further embodiments of the frame.
Figure 3:
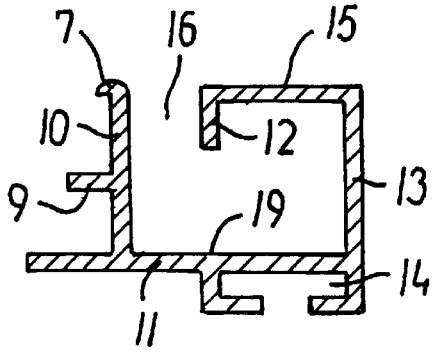

In the second embodiment shown in FIG. 2, the front surface 15 is curved, and the wall part 12 ends in a free edge 17 at a distance from the bottom surface so that a cavity 18 opens out into the clear gap 16. In FIG. 3, the bottom surface 11 is provided with a low-reflecting or light-absorbent coating 19, for example made of plastics, cloth or a paint. It is also possible to apply such coating inside the cavity 18. If only the cavity is coated, there is no change in the texture of the part of the bottom surface constituting the lower end of the clear gap, but the light entering the cavity from the screen wall 10 will not be reflected back to said part of the bottom surface, which consequently will appear darker.

Figure 4:
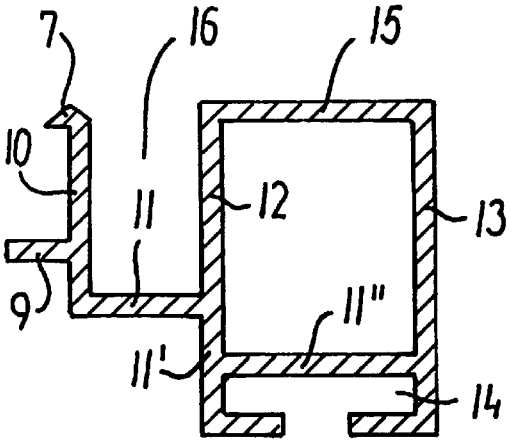

The embodiment in FIG. 4 has a stepped bottom surface 11, 11' and 11", which allows individual adaptation of the size of the side wall 13 and of the depth of the clear gap 16. The bottom surface may extend upwards or downwards and may form an acute or an obtuse angle with the screen wall.

Figure 5:
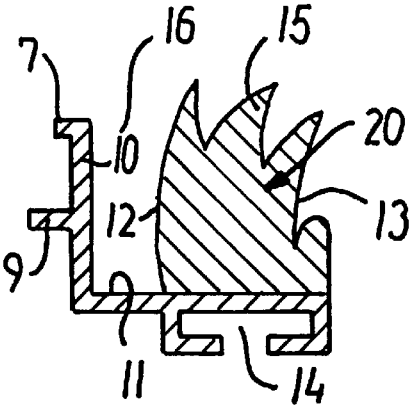

FIG. 5 shows a fifth embodiment in which, on the bottom surface, a separate element 20 is fixed which is shaped freely in a manner that primarily takes into account the design expression and not so much the purely technical factors in the mounting of the picture element, these factors being taken care of by the remaining part of the frame section. The element 20 may, for example, be made of plastics, profiled wood, foamed material, metal, cast or moulded material or another material with the currently desired design character. It is seen that the wall part 12, the front surface 15 and the external surface 13 are all located on the separate element, which may, for example, be screwed or glued onto the bottom surface 11.

Figure 6:
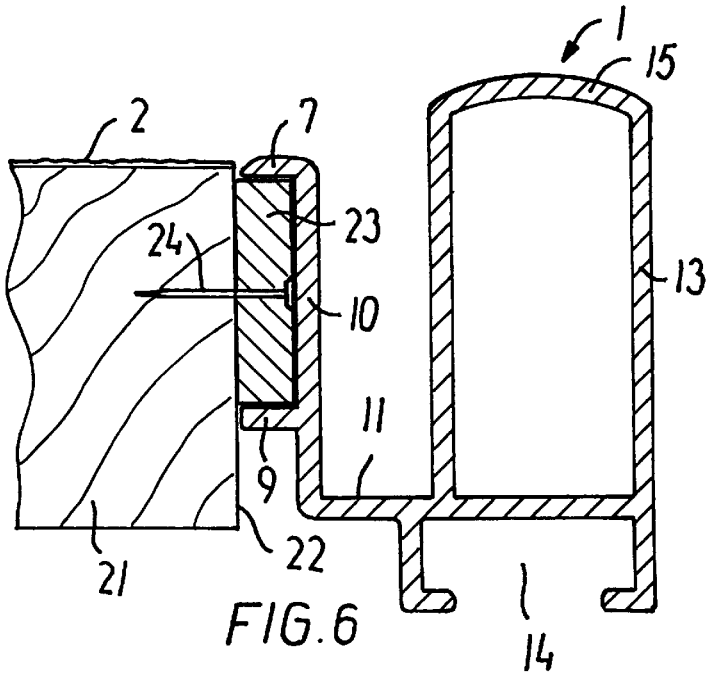
FIG. 6 is a cross-sectional view through another embodiment of the frame according to the invention.
Figure 7:
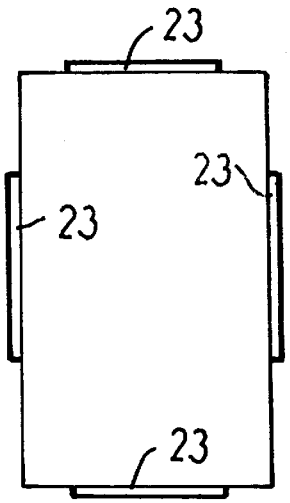
FIG. 7 is a side elevation of a painting ready for mounting in the frame of FIG. 6, FIGS. 8–10 are cross-sectional views of two modified embodiments of the frame.

A section of a picture on canvas 2 mounted on a stretsher 21 is depicted in FIG. 6. A mounting element 23 has been fixed to a side surface 22 of the stretcher by a fastening member, such as a nail 24, a screw, a tappet or the like. Lips 7, 9 on the frame section 1 have been inserted over either side of mounting element 23 so that it is fixed in the frame. At least one mounting element 23 is provided on each side surface of the stretcher (FIG. 7) and has been fixed in the pertaining frame section, thus fixing the whole picture element in the frame.

Frame sections and mounting elements can be delivered as a kit of parts where the mounting elements are specifically adapted to the dimensions of the frame sections, e. g. such that the mounting elements have a width substantially corresponding to the distance between the holding and supporting lips. After they have been fixed to the stretcher the mounting elements are positionally locked in the frame sections without use of any clip bodies. However, it is also possible to supply a kit of parts including clip bodies, and in this case the mounting elements can have a width smaller than said distance between said lips.

Mounting members 23 can be of plastics material, of wood or of any other form of stable material. They can have pre-fabricated bores for insertion of nails etc, or they can have pre-mounted fastening means, such as projecting teeth or nails. Mounting members 23 can also be manufactured out of sheet metal, that is e. g. be punched and shaped. The resulting mounting member can e. g. be U-shaped with a bottom leg width corresponding to the distance between lips 7, 9.

Figure 8:
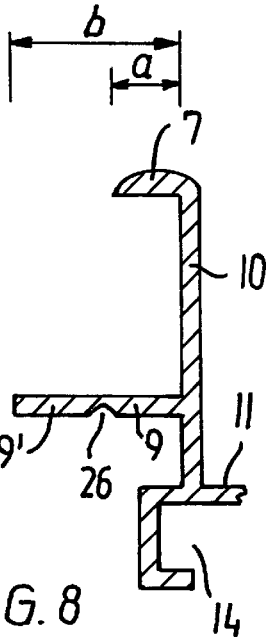
Figure 9:
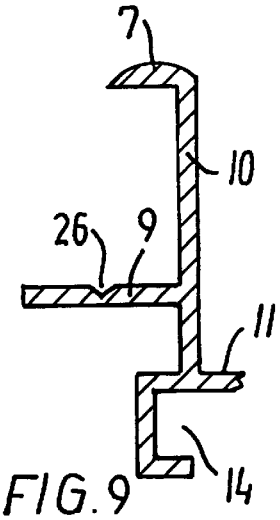
Figure 10:
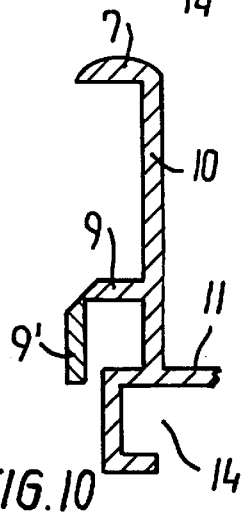

Referring now to FIGS. 8–10 showing embodiments that are suitable for framing several types of picture elements the holding lip 7 extends a first distance a away from screen wall 10, and the supporting lip 9 extends a larger distance b away from said screen wall. When the picture element is of the type depicted in FIG. 6 the larger supporting lip is inconvenient and a supporting lip of dimensions corresponding to the holding lip is preferred. The supporting lip has at the area of about said first distance a weakening line 26 extending longitudinally in parallel with the screen wall. The part 9' of lip 9 positioned opposite to wall can be swung up and down about the weakening line until it tears off resulting in a lip 9 of the desired dimensions.

In the variant of the frame shown in FIG. 9 and weakening line 26 is a notch line in the upwards facing surface of the supporting lip at a location slightly shorter than said first distance a from wall 10. When lip 9 is to be shortened, the lip portion 9' is simply bent about 90° downwards to the configuration shown in FIG. 10.

Figure 11:
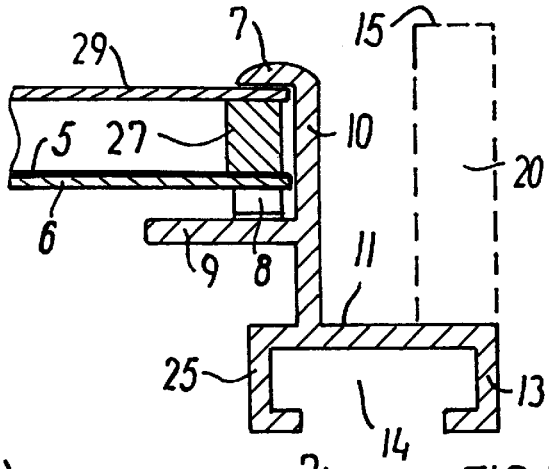
FIGS. 11–13 are cross-sectional views through further embodiments of the frame.

FIG. 11 depicts a variant of the frame, in which the screen wall 10 extends from the bottom wall of channel 14 at a distance from the inner side wall 25 of the channel. The picture element is of the type comprising a backing carrying a picture, a pane of glass 29, and a spacing member 27, which extends along the edges of the backing and separates the pane of glass from the picture. Front surface 15 is positioned on a separate element mounted on the frame section. In another embodiment shown in FIG. 12 front surface 15 is on a strip-shaped separate element 20 of moulded plastics which has been releasably fixed to the frame section by being, squeezed partly into a channel formed by the upright external side wall 13 and the upright wall part 12 so that tooth-shaped detent members 28 lock flictionally to said wall and wall part. This element 20 can be available in several different colours and/or front surface textures allowing the appearance of the frame to be changed by replacing an element 20 of one appearance with an element 20 of another appearance.

Figure 12:
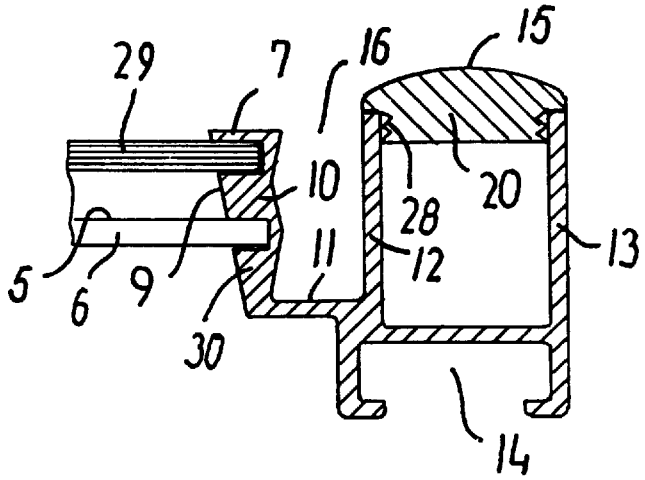
Figure 13:
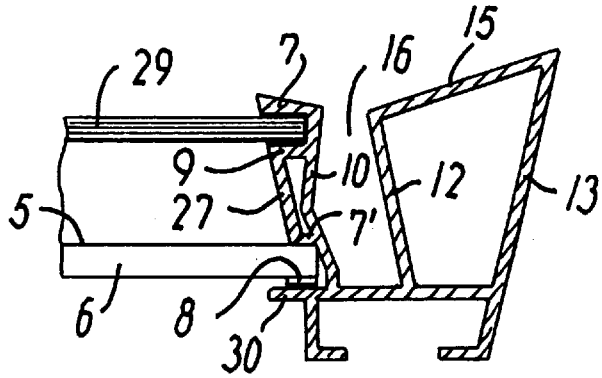

In the embodiment in FIG. 12 supporting lip 9 has been given considerable thickness corresponding to the desired separation between the pane of glass 29 and the printed or painted picture on backing or panel 6, which is mounted on a secondary supporting lip 30 on screen wall 10. The thick supporting lip 9 acts as spacing member so that use of a separate spacing member is superfluous and this greatly simplifies mounting of pictures with spacing members. The visible inner surface of the supporting lip can be coloured, e.g. white in order to resemble spacing members of cardboard. In the embodiment in FIG. 13 the same effect has been obtained but screen wall 10 has been made hollow, so that spacing member 27 appears as a separate wall section extending downward from the free edge of supporting lip 9. Opposite to lip 9 spacing member 27 is connected to screen wall 10 via a secondary holding lip 7'. The panel 6 is pressed out against the secondary holding lip 7' by springy clip bodies 8 inserted between the back of the panel and the secondary supporting lip 30. The visible surfaces of the frame have been mutually angled in obtuse and acute angles to obtain a more artistic, dynamic expression.

Figure 17:
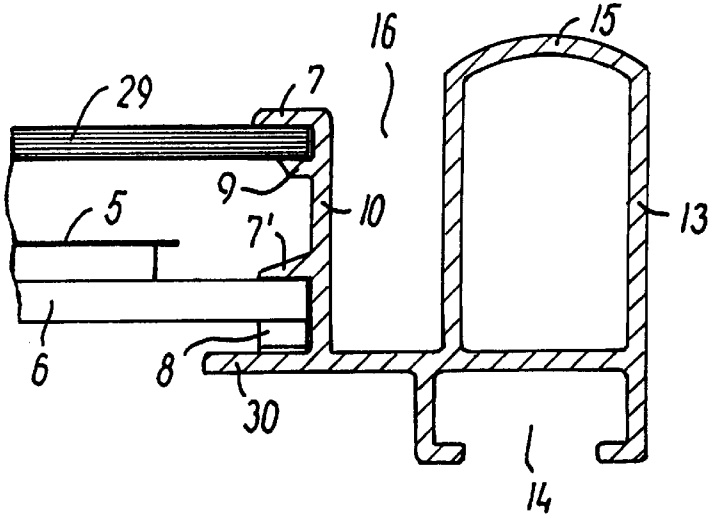
FIGS. 15–18 are cross-sectional views through further embodiments of the frame.
Figure 18:
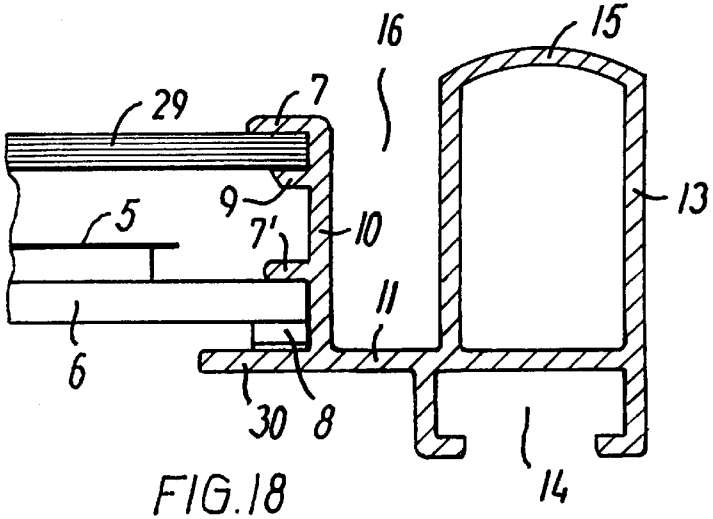
Figure 15:
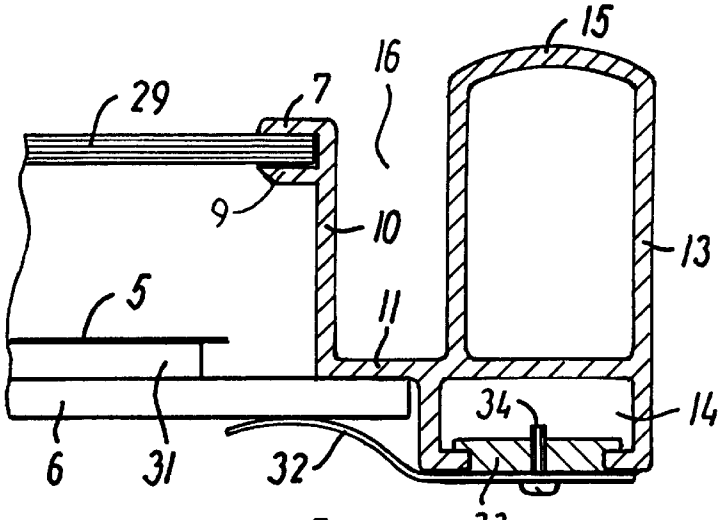
Figure 16:
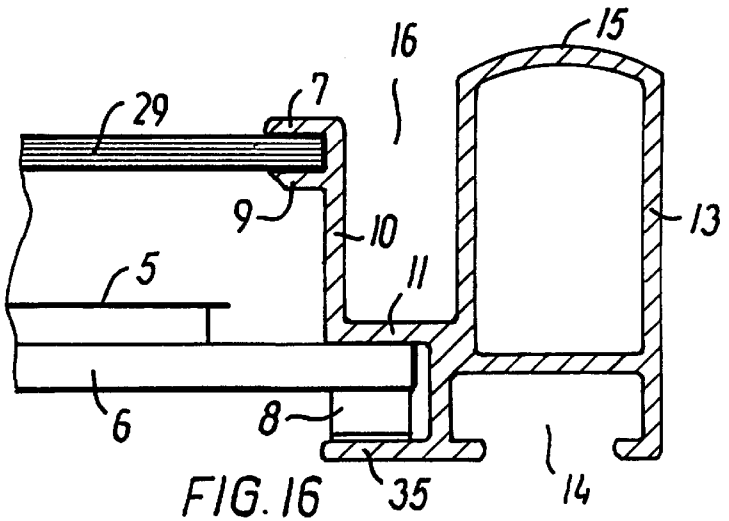

The embodiments shown in FIGS. 15–18 have a picture element in which the printed or painted picture on sheet 5 is elevated from panel 6 by a spacer 31 that can be plate-shaped or frame-shaped. Spacer 31 is fixed to panel 6 and sheet 5 is fixed to the spacer, e. g. by gluing or an adhesive. In FIGS. 15 and 16 the holding and supporting lips 7, 9 are of equal lengths, and in FIGS. 17–18 supporting lip 9 is shorter than holding lip 7. In FIG. 15 panel 6 is pressed outwards by leaf springs 32 fixed in the channel 14 by placing a fitting 33 in the channel and tightening a screw 34. In FIG. 16 panel 6 is pressed outwards by springy clip bodies 8 inserted between the panel and a lower supporting lip 35. In FIG. 17 panel 6 is pressed against secondary holding lip 7' by clip bodies 8 resting on secondary supporting lip 30, and the secondary holding lip 7' has a triangular cross-sectional shape with a bevelled upper surface. In FIG. 18 the secondary supporting lip 7' has even thickness and a rounded free edge.

Figure 20:
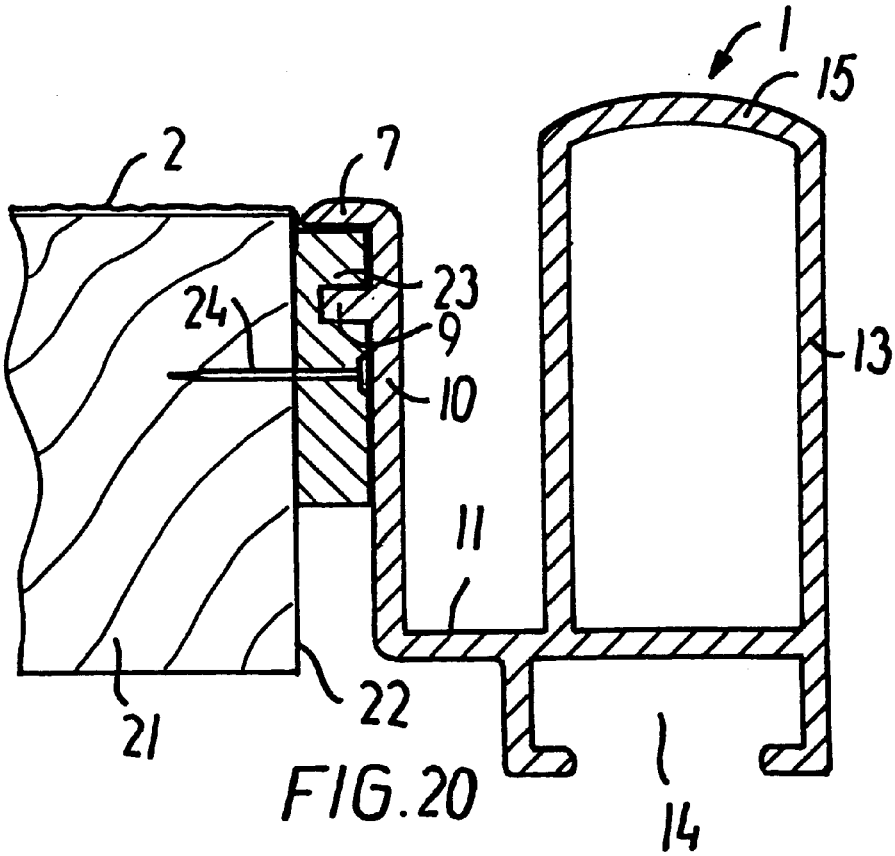
FIG. 20 is a view corresponding to FIG. 6 of another embodiment.

FIG. 20 depicts use of frame sections of the type shown in FIGS. 15 and 16 for mounting of a picture element of the type shown in FIG. 6, viz. a painting on canvas. Mounting members 23 are made with a groove having a width and a depth allowing the supporting lip 9 to be fittingly inserted into the groove. The groove is located at a distance from the upper side of the mounting member corresponding to the distance between holding and supporting lips 7, 9 so that a portion of the mounting member becomes locked between lips 7, 9.

Figure 14:
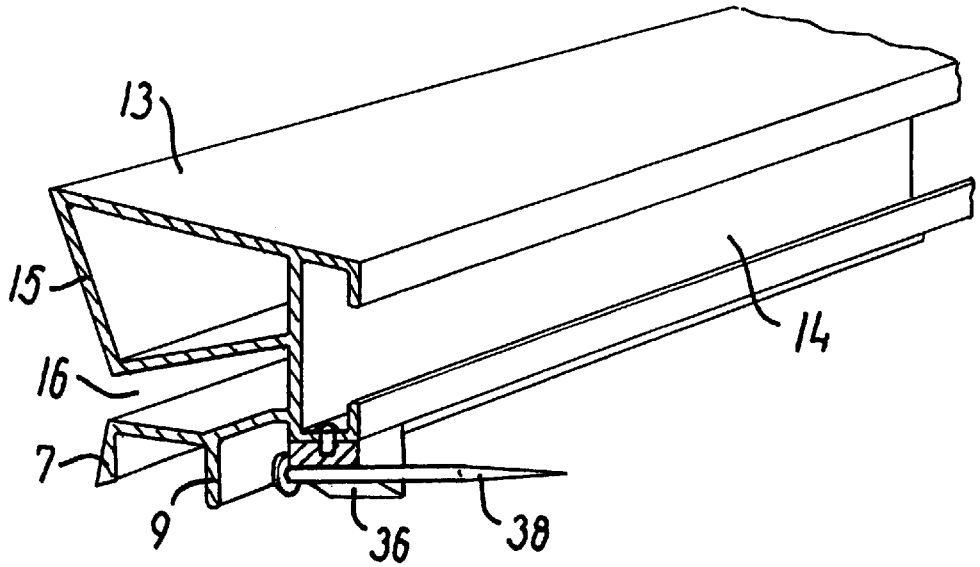
FIG. 14 is a partial perspective view of the embodiment in FIG. 13 with a mounting.
Figure 19:
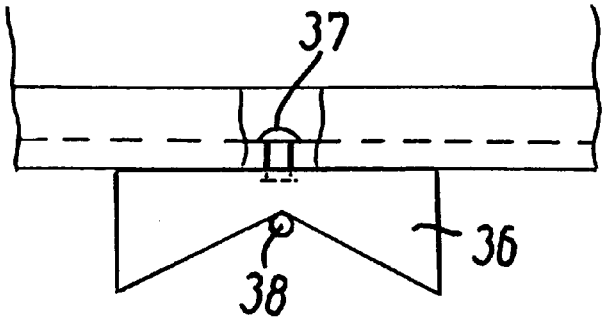
FIG. 19 is an elevation of a mounting.

When the frame with the mounted picture element is to be hung on a wall it is usual to mount a wire in the two vertical frame sections, and to place the middle portion of the wire on a nail fixed in that wall. When several pictures are placed next to each other on the wall it is a common desire to have the horizontal upper frame sections mutually in level. It is a time-consuming task to obtain this, even when the nails are at exactly the same height, because the wire lengths will vary. It is also a disadvantage that the horizontal upper frame section will hang at a distance from the wall. These problems can be solved by fixing a mounting 36 to the horizontal frame section at a position midway between the vertical frame sections. The mounting can e.g. be fixed to the lower side wall of channel 14 by using a screw or a rivet 37. Mounting 36 can have a V-shaped lower edge as shown in FIG. 19 so that it automatically centers itself when hung on a nail 38. In FIG. 14 the mounting is block-shaped, but it can also have other configurations such as being punched from sheet metal and bent at a right angle with one leg carrying screws for fixing to the wall of channel 14 and the other leg having the V-shaped lower edge.

It is obvious that details from the various embodiments can be combined in various ways, for example, the stepped bottom surface can be used in conjunction with a wall part ending in a free edge 17. Naturally, it is also possible to give the individual surfaces of the frame section other courses than straight ones, the front surface 15 may, for example, be curved as indicated in FIG. 2, be edged or toothed, etc. Likewise, the design of the holding lip may be varied, such as to the curved course shown in FIG. 3, an edged course as indicated in FIG. 4, and nor is it necessary for the front surface 15 to be flush with the holding lip.

In terms of material, the frame section is preferably made of extrudable aluminum, of plastics or of another extrudable metal or of a fibre material.

The longitudinal ratios between the screen wall 10 and the side wall 13 may deviate from that shown; the side wall may, for example, be longer than the screen wall. The sectional element may have different kinds of surface treatment, such as coatings, etchings or anodizations visually providing other material characters than aluminum.

What is claimed is:

1. A frame in combination with a picture element, comprising a plurality of frame sections, wherein each frame section has a bottom surface, a channel for receiving corner brackets, an upstanding screen wall on said bottom surface, an external side wall connecting the bottom surface with a visible front surface, and a clear gap between the front surface of the frame section and the screen wall, said visible front surface extending from the external side wall towards the screen wall, said screen wall having a projecting holding lip and a subjacent supporting lip for a picture element, said screen wall extending a distance down past the supporting lip to the bottom surface, and said clear gap between the front surface of the frame section and the screen wall being of a smaller width than said distance from the holding lip to the bottom surface, wherein said channel is formed by a pair of L-shaped members and a portion of the bottom surface.

2. A frame according to claim 1, wherein the screen wall distance between the supporting lip and the bottom surface is at least half of a distance from the holding lip to the supporting lip.

3. A frame according to claim 1, wherein the holding lip is at a shorter distance from the bottom surface than the visible front surface.

4. A frame according to claim 1, wherein the front surface of the frame section ends at the clear gap in a wall part extending substantially in parallel with the screen wall and towards the bottom surface.

5. A frame according to claim 4, wherein the wall part ends in a free edge located at a distance from the bottom surface.

6. A frame according to claim 4, wherein a back of the external side wall and of said front surface are matt and/or provided with a light-absorbent coating.

7. A frame according to claim 1, wherein the bottom surface is stepped.

8. A frame according to claim 1, wherein said width is approximately 8 mm.

9. A frame according to a claim 1, wherein the screen wall extends from a bottom wall of said channel.

10. A frame according to claim 9, wherein the screen wall is at a distance from an inner wall of the channel.

11. A frame according to claim 1, wherein the visible front surface and the outer surface of the frame section are disposed on a separate element mounted on a remaining part of the frame section.

12. A frame according to claim 1, wherein the holding lip extends over a rim area of a front of the picture element, said picture element comprising a backing to which is glued a sheet of paper with a printed picture coated with a protective, low-reflecting layer.

13. A frame according to claim 1, wherein the picture element is a painting on canvas mounted on a stretcher having side surfaces, at least one mounting element is fixed to each side surface of the stretcher, and the at least one mounting element is mounted in the frame held by the holding lip and the supporting lip.

14. A frame according to claim 13, wherein the mounting elements have a width corresponding to a distance between the holding lip and supporting lip.

15. A frame according to claim 13, wherein the holding lip extends a first distance away from the screen wall, the supporting lip extends a second distance away from the screen wall, said second distance is larger than said first distance, and wherein the supporting lip has a weakening line extending longitudinally in parallel with the screen wall at an area corresponding to said first distance.

16. A frame according to claim 1, wherein the picture element includes a pane of glass and a backing carrying a picture, and a spacing member extends along the edges of the backing and separates the pane of glass from the picture.

17. A frame according to claim 16, wherein the pane of glass is held between the holding lip and the supporting lip, and the spacing member is part of the frame section.

18. A frame according to claim 1, wherein an upper one of the frame sections carries a mounting fixed at the channel.

19. A frame for framing pictures and being composed of a plurality of frame sections, wherein each frame section has a channel for receiving corner brackets, a bottom surface with an upstanding screen wall, an external side wall with a visible front surface, and a clear gap between the front surface of the frame section and the screen wall, said screen wall having a projecting holding lip and a subjacent supporting lip for a picture element, said screen wall extending a distance down past the supporting lip to the bottom surface, and said clear gap between the front surface of the frame section and the screen wall being of a smaller width than said distance from the holding lip to the bottom surface, wherein said channel is formed by a pair of L-shaped members and a portion of the bottom surface.

20. A frame for framing pictures according to claim 19, wherein said picture element includes a pane of glass and a backing carrying a picture, said pane of glass being held between the holding lip and the supporting lip, and wherein the frame section holds the backing in a position with a spacing between the pane of glass and the picture.

21. A frame for framing pictures according to claim 20, wherein said picture is elevated from said backing by a spacer.

* * * * *